US007677549B2

(12) United States Patent
Kosugi

(10) Patent No.: US 7,677,549 B2
(45) Date of Patent: Mar. 16, 2010

(54) SHEET SUPPLYING APPARATUS

(75) Inventor: Akira Kosugi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 70 days.

(21) Appl. No.: 12/015,355

(22) Filed: Jan. 16, 2008

(65) Prior Publication Data

US 2008/0230982 A1 Sep. 25, 2008

(30) Foreign Application Priority Data

Mar. 19, 2007 (JP) ..... 2007-070293

(51) Int. Cl.
*B65H 3/44* (2006.01)

(52) U.S. Cl. ..... 271/9.13; 271/9.01; 271/9.08; 399/391

(58) Field of Classification Search ..... 271/90.1, 271/9.08, 9.11, 9.12, 9.13, 272, 273; 399/391, 399/393

See application file for complete search history.

(56) References Cited

U.S. PATENT DOCUMENTS 5,405,128 A * 4/1995 Fujiwara et al. ..... 271/9.13
5,765,825 A * 6/1998 Watase ..... 271/9.13
5,988,622 A * 11/1999 Shigeta ..... 271/9.01
6,145,828 A * 11/2000 Arai ..... 271/3.03
6,695,303 B2 * 2/2004 Okada et al. ..... 271/9.12
6,964,414 B2 * 11/2005 Willis ..... 271/272
6,976,672 B2 * 12/2005 Kawata ..... 271/9.11
7,167,663 B2 * 1/2007 Yoneda et al. ..... 399/124
7,168,701 B2 * 1/2007 Isaka et al. ..... 271/273
7,451,970 B2 * 11/2008 Kawata, Wataru ..... 270/58.14
2004/0253031 A1 12/2004 Okazaki
2006/0214352 A1 9/2006 Clark

FOREIGN PATENT DOCUMENTS

EP 1 219 451 A2 7/2002
EP 1 524 562 A2 4/2005

(Continued)

OTHER PUBLICATIONS

European Search Report dated December 2, 2009, in copending European Application No. 08250208.9 - 1256 / 1972580.

(Continued)

*Primary Examiner*—Kaitlin S Joerger
(74) *Attorney, Agent, or Firm*—Finnegan, Henderson, Farabow, Garrett & Dunner, L.L.P.

(57) ABSTRACT

A sheet supplying apparatus capable of being connected with sheet feeding apparatuses, image forming apparatuses and post processing apparatuses having: a common conveyance path to convey the sheet from the apparatuses on the upper stream side or sheet storing sections to down stream side having, a plurality of sheet feeding paths, a receiving conveyance path, a sending conveyance path, and a transit path to connect the receiving conveyance path and sending conveyance path, wherein the sending conveyance path has a shared conveyance path in which a plurality of sheet conveyance paths to feed the sheet from a plurality of the sheet storing sections are merge and reach to a sheet outlet, and the transit conveyance path is provided integrally with any one of the sheet storing sections, which can be withdrawn from a sheet supplying apparatus main body, at the bottom of the sheet storing section thereof.

6 Claims, 4 Drawing Sheets

FOREIGN PATENT DOCUMENTS

| | | | | |
|---|---|---|---|---|
| JP | 05097262 | A | * | 4/1993 |
| JP | 06156774 | A | * | 6/1994 |
| JP | 06263276 | A | * | 9/1994 |
| JP | 2004-029289 | | | 1/2004 |
| JP | 2005-3782 | | | 1/2005 |

OTHER PUBLICATIONS

Martin et al, "Expandable Feeder Module," Xerox Disclosure Journal, vol. 18 No. 6, p. 617, November 1, 1993.

* cited by examiner

SHEET SUPPLYING APPARATUS

This application is based on Japanese Patent Application No. 2007-070293 filed on Mar. 19, 2007, in Japanese Patent Office, the entire content of which is hereby incorporated by reference.

BACKGROUND OF THE INVENTION

The present invention relates to a sheet supplying apparatus having a sheet feeding section and a common conveyance path to supply a sheet from a sheet supplying apparatus and an image forming apparatus on an upper stream side to an image forming apparatus and a post processing apparatus on a down stream side in an image forming system to form an image where the image forming apparatus, the sheet feeding apparatus and the post processing apparatus are combined.

In case of a large amount of image forming is carried out for various kinds and various sizes of sheets such as the image forming system employing electrophotographic method disclosed in the Patent document 1, an image forming system where the sheet supplying apparatus and the post processing apparatus are combined are available.

Also, there is suggested a sheet supplying apparatus where a sheet discharged from the sheet feeding apparatus or the image forming apparatus connected at the upper stream side is conveyed through the common conveyance path of the sheet supplying apparatus and dispatched to the post processing apparatus or the image forming apparatus on the downstream side, or the sheet from a plurality of sheet storing section provided in the sheet supplying apparatus is sent to the image forming apparatus on the down stream side.

Patent document 1: Tokkai 2005-3782

As above, there is provided the sheet supplying apparatus having the common conveyance path which supplies the sheet of the sheet storing section to the apparatus on the down stream side by connecting the image forming apparatus, the sheet supplying apparatus and the post processing apparatus and conveys the sheet conveyed form the upper stream side to the apparatuses on the down stream side.

However, since this common conveyance paths are provided independently between a plurality of respective sheet storing sections, they occupy a large space and reduces an amount of sheet to be stored in the respective sheet storing sections, thus there was a disadvantage that the system adaptable to various kinds and various sizes of sheets enormously increases the space occupied by the system.

Further, in the common conveyance path, there was another disadvantage that a receiving conveyance path to receive the sheet from the upper stream side or a discharging conveyance path to discharge the sheet to the downstream side have less possibility of design since the height and the position are fixed.

SUMMARY OF THE INVENTION

An object of the present invention is to provide a sheet supplying apparatus which can be utilized for various image forming with a high productivity capable of solving the disadvantages of the conventional art.

The above object can be achieved by the following sheet supplying apparatus. A sheet supplying apparatus to supply a sheet capable of being connected with a sheet feeding apparatus, an image forming apparatus or a post-processing apparatus on an upper stream side and a down stream side of the sheet supplying apparatus in the sheet conveyance direction, the sheet supplying apparatus having: a plurality of sheet storing sections to store the sheet; and a common conveyance path to convey the sheet conveyed from the sheet feeding apparatus or the image forming apparatus on the upper stream side, or the sheet fed from the plurality of the sheet storing sections to the image forming apparatus or the post-processing apparatus on the down stream side having, a plurality of sheet feeding paths to feed the sheet from the plurality of the sheet storing sections, a receiving conveyance path to receive the sheet conveyed from the sheet feeding apparatus or the image forming apparatus connected to the sheet supplying apparatus at the upper stream side through a sheet inlet, a sending conveyance path to send the sheet conveyed from the sheet feeding apparatus or the image forming apparatus on the upper stream side to the image forming apparatus or the post-processing apparatus connected to the sheet supplying apparatus at the down stream side, and a transit conveyance path to connect the receiving conveyance path and the sending conveyance path, wherein, the sending conveyance path has a shared conveyance path configured by merging a plurality of sheet conveyance paths to feed the sheet from the plurality of the sheet storing sections so as to reach to the sheet outlet, the plurality of the sheet storing sections are provided in a way to be able to withdraw from a sheet supplying apparatus main body and the transit conveyance path is provided integrally with any one of the plurality of the sheet storing sections at a bottom of the sheet storing section thereof.

DETAILED DESCRIPTION OF THE PREFERRED EMBODIMENT

Image Forming System

Figure 1:
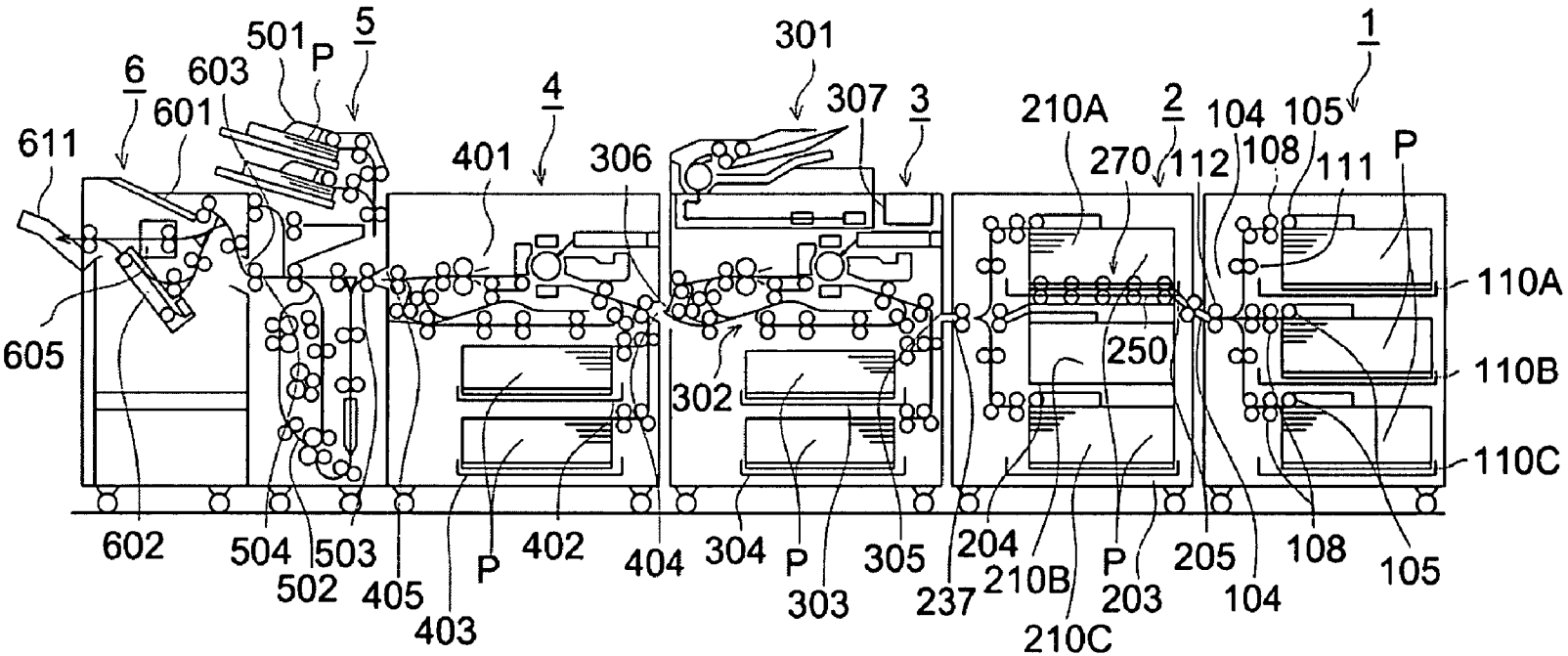
FIG. 1 is a schematic drawing showing an example of an image forming system configured by incorporating a sheet supplying apparatus.

FIG. 1 is a schematic drawing showing an example of configuring an image forming system where a sheet supplying apparatus is incorporated. Nonvolatile An image forming system of the present example is configured with a sheet supplying apparatus, a sheet feeding apparatus 1 incorporated on an upper stream side, two image forming apparatuses 3 and 4 incorporated on a down stream side and two post-processing apparatus 5 and 6. The aforesaid sheet supplying 2 is provided with a common conveyance path 270, wherein a transit conveyance path 250 occupying the most part of the common conveyance path thereof is integrally mounted on any one of the plurality of sheet storing section. Contrarily, the sheet feeding apparatus 1 is a conventional image forming apparatus having been commonly used as a peripheral which is not provided with the common conveyance path 270.

The sheet feeding apparatus 1 on the upper stream side is provided with three sheet storing sections 110A, 110B and 110C to store a sheet P. The sheet supplying apparatus 2 of the present invention is provided with three sheet storing sections 210A, 210B and 210C to store the sheet P. In sheet supplying apparatus 2, the transit conveyance section 250 is provided in one of the sheet storing sections as a part of the common conveyance path 270 and, for example, the sheet P fed from the sheet feeding apparatus 1 is conveyed to the image forming apparatus 3 through the common conveyance path 270. Image forming apparatus 3 is provided with an image reading section 301, an image forming section 302, sheet storing sections 303 and 304 and a communication interface 307. The sheet storing sections 303 and 304 store the sheet P. The image forming apparatus 4 is provided with an image forming section 401, and sheet storing sections 402 and 403 where the sheet storing sections 402 and 403 store the sheet P.

A post-processing apparatuses 5 is provided with a sheet supplying section 501 and a folding section 502. The post-processing apparatus 6 is provided with a fixed sheet discharging tray 601, a sewing process section 602 and a hoisting sheet discharging try 611 and a shift processing section 605.

The sheet P stored in the sheet feeding apparatus 1 on the upper stream side is discharged from a sheet outlet 104, led to a sheet inlet 205 of the sheet supplying apparatus 2, discharged from a sheet discharging outlet 237 and conveyed to a sheet inlet 305 of the image forming apparatus 3.

Also, the sheet P stored in the sheet supplying apparatus 2 on the upper stream side is discharged from the same sheet outlet 237 as the aforesaid sheet outlet and conveyed to the sheet inlet 305 of the image forming apparatus 3.

Image forming on the sheet P is carried out in the image forming apparatus 3 and the image forming apparatus 4. Namely, image forming on the sheet P stored in the sheet feeding apparatus 1 on the upper stream side, the sheet supplying apparatus 2 or the image forming apparatus 3 is carried out in the image forming apparatus 3. Also, image forming on the sheet P stored in the sheet feeding apparatus 1, the sheet supplying apparatus 2 and the image forming apparatus 3 or the image forming apparatus 4 is carried out in the image forming apparatus 4.

The image forming apparatus 3 is used as a master unit and the image forming apparatus 4 is used as a slave unit. That is, the image forming apparatus 3 having the image reading section 301 reads a document to create an image data and has the communication interface 307 to receive image data from outside.

In case a large amount of image is formed, image data is stored separately in image forming apparatuses 3 and 4, and in case the image is formed on a single side or double side, image forming on an obverse surface is carried out in the image forming apparatus 3 and the image forming on an reverse surface is carried out in the image forming apparatus 4. As above, the image forming apparatus 3 and the image forming apparatus 4 share the functions thereby, a large amount of image forming can be carried out with a high efficiency.

The sheet P processed in the image forming apparatus 4, is discharged from a sheet outlet 405 and led to a sheet inlet 503 of the post processing apparatus 5. Sheet P after folding 502 is led to sheet inlet 603 of the post processing apparatus 6 from the sheet outlet 504.

The sheet P, on which stapling and shifting process are not carried out, is discharged to a fixed sheet discharging tray 601, and in case the post-processes thereof are carried out, the sheet P is discharged to the hoisting sheet discharging tray 611 after the post-processes.

The sheet feeding apparatus 1, the sheet supplying apparatus 2, the image forming apparatus 3, the image forming apparatus 4, the sheet post processing apparatus 5 and the post processing apparatus 6 are connected with connection members.

The above is a description of an exemplary image forming system, and the connection order is not limited to the order thereof, for example, the image forming apparatus can be connect on the upstream side of the sheet supplying apparatus 2 in addition to sheet feeding apparatus 1. Also, a plurality of the sheet supplying apparatuses 2 can be inserted serially by arranging next to the upper stream side or the downstream side of the sheet supplying apparatus 2.

<Sheet Supplying Apparatus>

As the above, as FIG. 1 shows, the sheet feeding apparatus 1 connected to the upper stream side of the sheet supplying apparatus 2 is provided with three sheet storing sections 110A, 110B and 110C and feeding rollers 105 and separating rollers 108 are equipped corresponding to each of the sheet storing sections.

For example, the sheet P stored in the sheet storing section 110A is fed by a feeding roller 105 and separated into one piece by separating rollers 108 and conveyed, then conveyed by an intermediated conveyance rollers 111 and then discharged from the sheet outlet 104 towards the sheet supplying apparatus 2 by discharging rollers 112.

Figure 2:
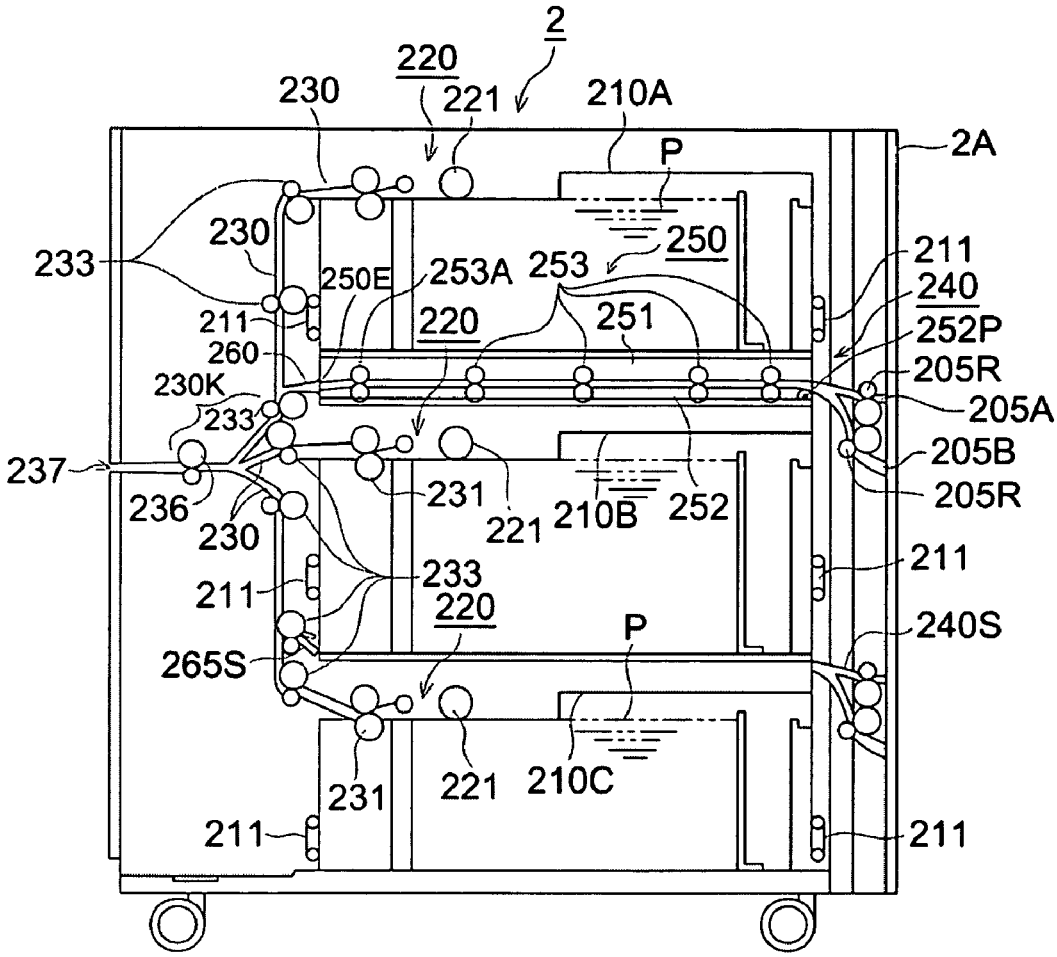
FIG. 2 is a front view showing an exemplary embodiment of a sheet feeding apparatus of the present invention.
Figure 3:
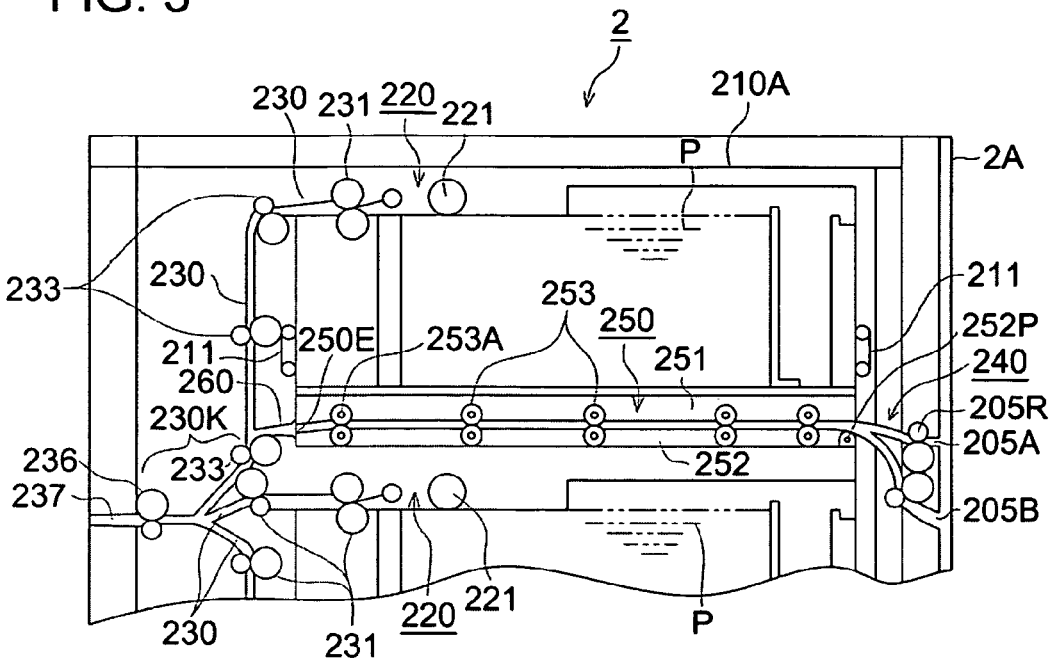
FIG. 3 is a partial magnification of FIG. 2.

The sheet supplying apparatus 2 of the present invention is described specifically with reference to a front view of FIG. 2 and FIG. 3 representing a partial magnification of FIG. 2 as follow.

The sheet supplying apparatus 2 having a plurality of the sheet storing sections 201A, 201B and 201C is capable of connecting with the sheet feeding apparatus 1 arranged on upper stream side in a conveyance direction of the sheet P and capable of connecting with image forming apparatus 3 or 4, or the post-processing apparatus 5 or 6 arranged on the down stream side in a conveyance direction of the sheet P.

Also, the sheet supplying apparatus 2 of the present invention is provided with the common conveyance path 270 having a receiving conveyance path 240 which receives the sheet P supplied from the sheet feeding apparatus 1 on upper stream side at sheet inlets 205 A and 205B, a sending conveyance path 260 to send the sheet P supplied from the sheet feeding apparatus 1 on upper stream side to the image forming apparatus 3 and 4, or the post-processing apparatus 5 and 6, and a transit conveyance path 250 to connect the receiving conveyance path 240 and the sending conveyance path 260.

Further, the sending conveyance path 260 is provided with a shared conveyance path 230K wherein the sheet feeding paths 230 of a plurality of the sheet storing sections 210A, 210B and 210C merge and reach to the sheet outlet 237.

Also, a plurality of the sheet storing sections 210*a*, 210B and 210C are provided in a way that they can be withdrawn from the sheet supplying apparatus main body 2A and the transit conveyance path 250 is integrated with any one of the sheet storing sections 210A, 210B or 210C (in the present invention it is 210A) at the bottom of the sheet storing section thereof.

The sheet supplying apparatus 2 has a function where the sheet P is led from the sheet feeding apparatus 1 on the upper stream side to the sheet inlet 205A or 205B and conveyance by leading rollers 205R of the received sheet P is started, and the sheet P is supplied to an inlet 305 of the image forming apparatus 3 from the sheet outlet 237 via the common conveyance path 270 configured with the receiving conveyance path 240, the transit conveyance path 250 and the sending conveyance path 260, and a function to supply the sheet P from the sheet storing sections 21A, 21B and 21C.

Namely, the sheet P received from the sheet feeding apparatus 1 on the upper stream side is conveyed by the leading roller 205R of the receiving conveyance path 240, the conveyance rollers 253 of the transit conveyance path 250 and the sending conveyance path 260, and discharged from the sheet outlet 237 by the discharging roller 236.

On the other hand, in the sheet storing sections 210A, 210B and 210C, the sheet P is aligned by restriction plates in lateral and longitudinal positions, and placed on an accumulation table. Then, the position of the accumulation table is controlled so as to a top section of the sheets is kept within a predetermined range. The sheet P is fed by a feeding roller 221 and fed by the sheet feeding section 220 where the separation roller 231 separately conveys the sheet P by one piece then the sheet P is conveyed by an intermediate conveyance rollers 233 through the sheet feeding path 230 and then discharged by the discharging roller 236 from the sheet outlet 237 in the same manner as the sheets conveyed from the upper stream side through the common conveyance path 270.

Now, the transit conveyance path 250 having an upper guide plate 251, a lower guide plate 252 and conveyance rollers 253 forms a conveyance path and roller pairs. The conveyance rollers 253 mounted at the upper guide plate 251 are connected to a drive section of the sheet supplying apparatus main body 2A provided at a back side of the sheet storing section 210. As the side cross-sectional views of FIG. 4 and FIG. 5 show, by withdrawing the sheet storing section 210A, with which the transit conveyance path 250 is provided integrally, from the sheet supplying apparatus 2A, the lower guide plate 252 can be open.

Figure 4:
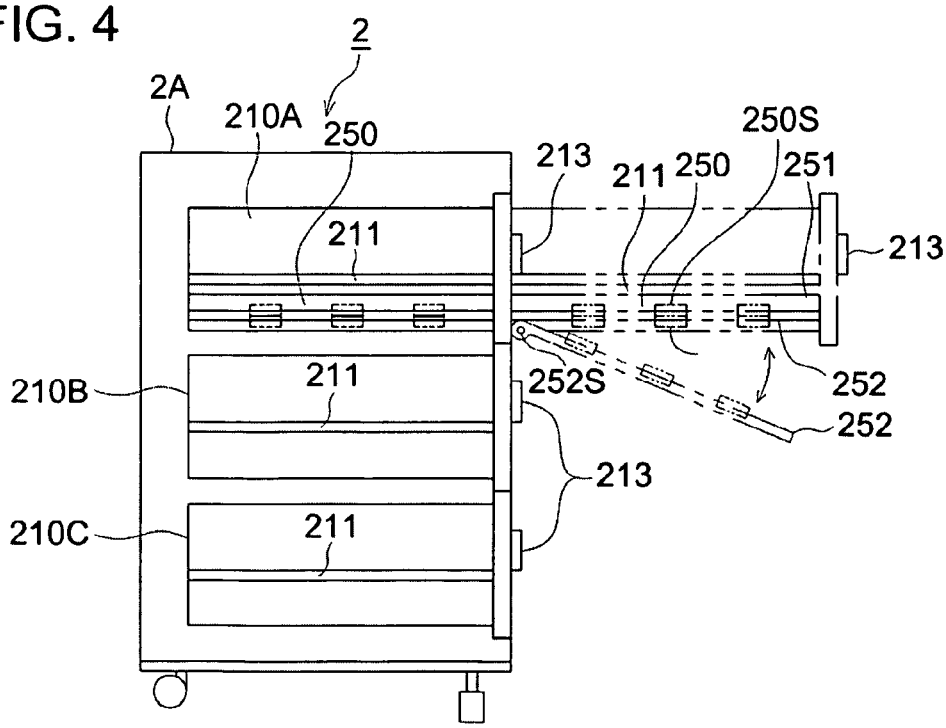
FIG. 4 is a side view of a sheet supplying apparatus showing an exemplary state where a sheet storing section integrated with a transit conveyance path is withdrawn to open a transit conveyance path.
Figure 5:
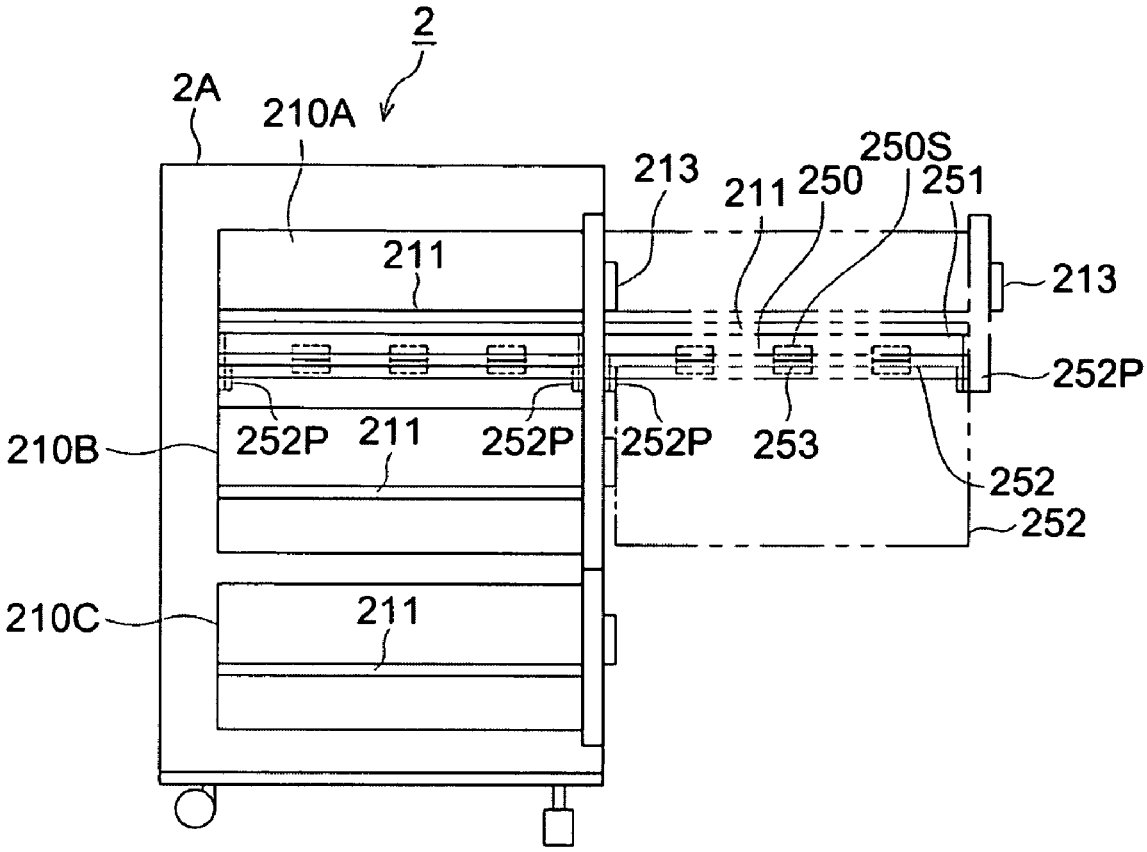
FIG. 5 is a side view of a sheet supplying apparatus showing the other exemplary state where a sheet storing section integrated with a transit conveyance path is withdrawn to open the transit conveyance path.

In FIG. 4, the lower guide plate 252 is supported by an axis 252S at an edge section at the back which is perpendicular to a direction of withdrawing the sheet storing section 210A from the sheet supplying apparatus main body 2A. Thanks to the above, when the sheet conveyed from the upper stream side jams, it can be removed readily.

Meanwhile, the conveyance roller at the lowermost stream of the transit conveyance path 250 is a resist roller 253A where the sheet P stops once to correct a skew of the sheet. In case jamming occurs, it is driven so that a front edge of the sheet reaches to the resist roller 253A. Since the transit conveyance path 250 is configured to have a length for storing the sheet P of maximum size, the sheet remains inside the transit conveyance path without fail when jamming occurs.

Therefore, when jamming occurs, the sheet being conveyed in the receiving conveyance path 240 moves to inside of the transit conveyance path 250 and stops without fail. Thus, when the sheet storing section 210A is withdrawn, it does not occur that the sheet occupies across the receiving conveyance path and the transit conveyance path and the sheet is caught by the paths thereof then the sheet storing section 210A cannot be withdrawn. Thereby jamming can be resolve readily.

In FIG. 5, the lower guide palate 252 is pivotally supported by an axis 252P at a side section which is in contact with the receiving conveyance path 240 and parallel to a direction in which the sheet storing section 210A is withdrawn from the sheet supplying apparatus main body 2A. In the same manner as in FIG. 4, when the sheet conveyed from the upper stream side jams, it can be removed readily and the apparatus can be recovered.

At the same time, since the feeding roller 221 is provided in the sheet supplying apparatus main body 2A, the sheet P can be readily refilled and loaded onto the withdrawn sheet strong section 210A.

The plurality of the sheet storing sections 210*a*, 210B, and 210C are provided with handles respectively so as to withdraw the sheet storing sections 210*a*, 210B, and 210C along a telescopic guide rail 211 readily. Further, by withdrawing the sheet storing sections, they can be replaced each other in a plurality of selected refilling positions.

Namely, a total height of the sheet storing sections 210A, 210B and 210C are the same each other, and heights of the guide rails provided at each refilling position are the same for each sheet storing section 210*a*, 210B and 210C to realize compatibility, thereby each sheet storing section 210A, 210B and 210C can be loaded precisely and readily at any heights (stages).

For example, in case the sheet storing section 210A having the common conveyance path 270 is loaded at a lowest stage, by providing the sheet inlet 205 and subsequent receiving conveyance path 240S at that stage, and by providing the connection conveyance path 265S on the sending conveyance path 260 side, a possibility of connection positions is expanded extensively, even in case the discharging position of the sheet feeding apparatus on the upper stream side is variegated.

According the above embodiment of the sheet supplying apparatus where the common conveyance path to convey the sheet conveyed from the upper stream side to the down stream side is mounted integrally on the bottom of the sheet storing section, a storing capacity of the sheet supplying apparatus can be increased, various kinds of image forming is possible and a small space can be efficiently utilized without changing total size.

What is claimed is:

1. A sheet supplying apparatus for supplying a sheet, the sheet supplying apparatus being connected with a sheet feeding apparatus, an image forming apparatus, and a post-processing apparatus on an upper stream side and a down stream side of the sheet supplying apparatus in a sheet conveyance direction, the sheet supplying apparatus comprising:

a plurality of sheet storing sections for storing the sheet; and a common conveyance path for conveying the sheet conveyed from the sheet feeding apparatus or the image forming apparatus on the upper stream side, or the sheet fed from the plurality of the sheet storing sections to the image forming apparatus or the post-processing apparatus on the down stream side, the common conveyance path comprising, a plurality of sheet feeding paths for feeding the sheet from the plurality of the sheet storing sections, a receiving conveyance path for receiving the sheet conveyed from the sheet feeding apparatus or the image forming apparatus connected to the sheet supplying apparatus through a sheet inlet at the upper stream side, a sending conveyance path for sending the sheet conveyed from the sheet feeding apparatus or the image forming apparatus on the upper stream side to the image forming apparatus or the post-processing apparatus connected to the sheet supplying apparatus at the down stream side, and a transit conveyance path for connecting the receiving conveyance path and the sending conveyance path, wherein the sending conveyance path has a shared conveyance path formed by merging a plurality of sheet conveyance paths for feeding the sheet from the plurality of sheet storing sections to a sheet outlet, wherein the plurality of sheet storing sections are able to be withdrawn from a sheet supplying apparatus main body, and wherein the transit conveyance path is integrally provided at a bottom portion of any one of the plurality of sheet storing sections, the transit conveyance path being withdrawn together with the sheet storing section.

2. The sheet supplying apparatus of claim 1, wherein the transit conveyance path is provided with a lower guide plate which can be opened by withdrawing the sheet storing section, from the sheet supplying apparatus main body.

3. The sheet supplying apparatus of claim 2, wherein the lower guide plate is pivotally supported by an axis at an edge portion at a back perpendicular to a direction in which the sheet storing section is withdrawn from the sheet supplying apparatus main body.

4. The sheet supplying apparatus of claim 2, wherein the lower guide plate is pivotally supported by an axis at an edge portion in contact with the receiving conveyance path parallel to a direction in which the sheet storing section is withdrawn from the sheet supplying apparatus main body.

5. The sheet supplying apparatus of claim 1, wherein the plurality of the sheet storing sections can be exchanged with each other and loaded in a plurality of selected loading positions.

6. The sheet supplying apparatus of claim 1, wherein the transit conveyance path includes a resist roller.

* * * * *